US009599321B2

(12) United States Patent
Sorensen et al.

(10) Patent No.: US 9,599,321 B2
(45) Date of Patent: Mar. 21, 2017

(54) LED LIGHTING AND CONNECTING SYSTEM

(71) Applicant: Litetronics International, Inc., Harvey, IL (US)

(72) Inventors: Robert Sorensen, Harvey, IL (US); Raghu Rao, Romeoville, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 14/941,594

(22) Filed: Nov. 14, 2015

(65) Prior Publication Data

US 2016/0201890 A1 Jul. 14, 2016

Related U.S. Application Data

(60) Provisional application No. 62/103,099, filed on Jan. 14, 2015.

(51) Int. Cl.

| | |
|---|---|
| ***F21S 2/00*** | (2016.01) |
| ***F21V 19/00*** | (2006.01) |
| ***F21V 23/06*** | (2006.01) |
| ***G09F 13/22*** | (2006.01) |
| ***G09F 13/04*** | (2006.01) |
| ***F21V 21/096*** | (2006.01) |
| ***F21V 23/00*** | (2015.01) |
| ***F21V 21/35*** | (2006.01) |
| ***H01R 25/14*** | (2006.01) |
| ***H01R 13/625*** | (2006.01) |
| *H01R 103/00* | (2006.01) |
| *H01R 33/94* | (2006.01) |

(52) U.S. Cl.

CPC ..... *F21V 19/008* (2013.01); *F21K 9/27* (2016.08); *F21V 21/096* (2013.01); *F21V 21/35* (2013.01); *F21V 23/001* (2013.01); *F21V 23/06* (2013.01); *G09F 13/04* (2013.01); *G09F 13/22* (2013.01); *H01R 13/625* (2013.01); *H01R 25/14* (2013.01); *H01R 25/142* (2013.01); *F21Y 2103/10* (2016.08); *F21Y 2115/10* (2016.08); *G09F 2013/222* (2013.01); *H01R 33/94* (2013.01); *H01R 2103/00* (2013.01)

(58) Field of Classification Search

CPC . F21K 9/13; F21K 9/175; F21V 23/06; F21V 19/008; F21V 21/35

USPC ..... 362/217.14–217.17

See application file for complete search history.

(56) References Cited

U.S. PATENT DOCUMENTS

2008/0080175 A1* 4/2008 Lee ..... F21V 14/02 362/223

2010/0208476 A1* 8/2010 Laso ..... F21V 17/007 362/429

(Continued)

*Primary Examiner* — Evan Dzierzynski

*Assistant Examiner* — Gerald J Sufleta, II

(74) *Attorney, Agent, or Firm* — Steve Witters; Witters & Associates

(57) ABSTRACT

An LED lighting system comprising at least one LED luminaire is provided. An LED luminaire may comprise at least one longitudinally extending LED light source, a first LED light source holder holding a first end of the LED light sources and having a first electrical socket in electrical communication with the LED light sources. A second LED light source holder holds a second end of the LED light sources. The LED light source holders are configured to hold the LED luminaire in place.

19 Claims, 15 Drawing Sheets

(56) References Cited

U.S. PATENT DOCUMENTS

| | | | | |
|---|---|---|---|---|
| 2011/0235319 | A1* | 9/2011 | Fukano | F21K 9/175 362/217.14 |
| 2013/0002164 | A1* | 1/2013 | Galluccio | F21V 19/00 315/294 |
| 2014/0036505 | A1* | 2/2014 | Barton | F21V 21/005 362/249.06 |
| 2014/0226325 | A1* | 8/2014 | Allen | F21V 21/088 362/231 |
| 2015/0204522 | A1* | 7/2015 | Baumeister | F21K 9/175 362/217.16 |

* cited by examiner

LED LIGHTING AND CONNECTING SYSTEM

CROSS-REFERENCE TO RELATED APPLICATIONS

This application claims the benefit of U.S. Application No. 62/103,099, filed Jan. 14, 2015, entitled LED Lamp System, which is hereby incorporated by reference in its entirety.

FIELD OF THE DISCLOSURE

This invention generally relates to light systems or fixtures, and, more particularly, to an LED lighting system.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

Surface mount and recessed fluorescent light fixtures, such as strip and troffer light fixtures, have typically been installed to provide general lighting of large indoor spaces. For example, surface mount and recessed type fluorescent strip light fixtures may include stem and pendant mounted suspended variations as well as those fixtures mounted directly to a ceiling or in the ceiling.

Typically, such strip fixtures include a channel in the form of an inverted trough or troffer, with the channel being attached to or recessed in the ceiling. Lamp holders or sockets are attached to the channel or troffer. A ballast is attached within the channel and wiring attaches the ballast to the lamp holders. Power is supplied to the ballast by wiring brought into the channel through the top or end of the channel. A ballast cover is used to cover the ballast and wiring. Linear fluorescent lamps are then placed in the lamp holders for operation of the fixture. The lamps may be left bare or covered for providing light to the space below. Because of their low cost and utilitarian use, fluorescent strip light fixtures are currently installed in abundance. For example, typical uses include warehouses, retail stores, such as grocery, drug, and department stores, where the fixtures are commonly mounted in continuous rows.

Since the introduction of the fluorescent lamp at the 1939 World Fair, fluorescent lighting technology has greatly advanced. For example, over the years, lamp and ballast manufacturers have developed fluorescent lamp-ballast systems with improved efficiencies. More recently, light emitting diode (LED) LED lamps have been developed. An LED lamp uses solid-state LEDs as the source of light. An LED may comprise a conventional semiconductor light emitting diode or an organic or polymeric light emitting diode. LED lamps may have one or more advantages over fluorescent lamps, for example, LED lamps do not contain mercury, they may turn on more instantaneously, they may have a longer service life, and they may have a greater efficiency.

It may be desired to provide advantages of LEDs to light fixtures and lighting systems that have traditionally used fluorescent lamps.

SUMMARY

In at least one aspect of the present disclosure, an LED lighting system is provided. The LED lighting system may comprise at least one LED luminaire having at least one longitudinally extending LED light source having a length greater than a width. A first LED light source holder may hold a first longitudinal end of each of the at least one longitudinally extending LED light sources. The first LED light source holder may have at least a first electrical socket in electrical communication with a first end of each of the at least one longitudinally extending LED light sources and a power source. A second LED light source holder may hold a second longitudinal end of each of the at least one longitudinally extending LED light sources held with the first LED light source holder. The second LED light source holder may have at least a second electrical socket in electrical communication with a second end of each of the at least one longitudinally extending LED light sources held with the first LED light source holder. The first electrical socket and the second electrical socket may each have a receiving axis substantially perpendicular to a longitudinal axis of the at least one longitudinally extending LED light source.

In at least one other aspect of the present disclosure, an LED lighting system is provided. The LED lighting system may comprise at least one LED luminaire, wherein each of the at least one LED luminaire may comprise at least one longitudinally extending LED light source having a length greater than a width. A first LED light source holder may hold a first longitudinal end of each of the at least one longitudinally extending LED light sources. The first LED light source holder may be configured to provide electrical communication between a first end of each of the at least one longitudinally extending LED light sources and a power source. A second LED light source holder may hold a second longitudinal end of each of the at least one longitudinally extending LED light sources held with the first LED light source holder. The first LED light source holder and the second LED light source holder may be configured to hold the luminaire to a structure, hang the luminaire from a structure, or hold the luminaire to a portion of a luminaire being retrofitted.

In yet another aspect of the present disclosure, an LED retrofit system comprising at least one LED luminaire is provided. Each of the at least one LED luminaire may comprise at least one longitudinally extending LED light source having a length greater than a width. A first LED light source holder may hold a first longitudinal end of each of the at least one longitudinally extending LED light sources. The first LED light source holder may be configured to provide electrical communication between a first end of each of the at least one longitudinally extending LED light sources and a power source. A second LED light source holder may hold a second longitudinal end of each of the at least one longitudinally extending LED light sources held with the first LED light source holder. The first LED light source holder and the second LED light source holder may be configured to hold the luminaire to a portion of a luminaire being retrofitted.

BRIEF DESCRIPTIONS OF THE DRAWINGS

The following figures, which are idealized, are not to scale and are intended to be merely illustrative of aspects of the present disclosure and non-limiting. In the drawings, like elements may be depicted by like reference numerals. The drawings are briefly described as follows.

DETAILED DESCRIPTION

Reference will now be made in detail to the present exemplary embodiments and aspects of the present invention, examples of which are illustrated in the accompanying figures. The same reference numbers may be used in the figures to refer to the same or like parts. The presently disclosed embodiments, aspects, and features of the present invention are not to limit the presently claimed invention as other and different embodiments, aspects, and features will become apparent to one skilled in the art upon reading the present disclosure.

Figure 1:
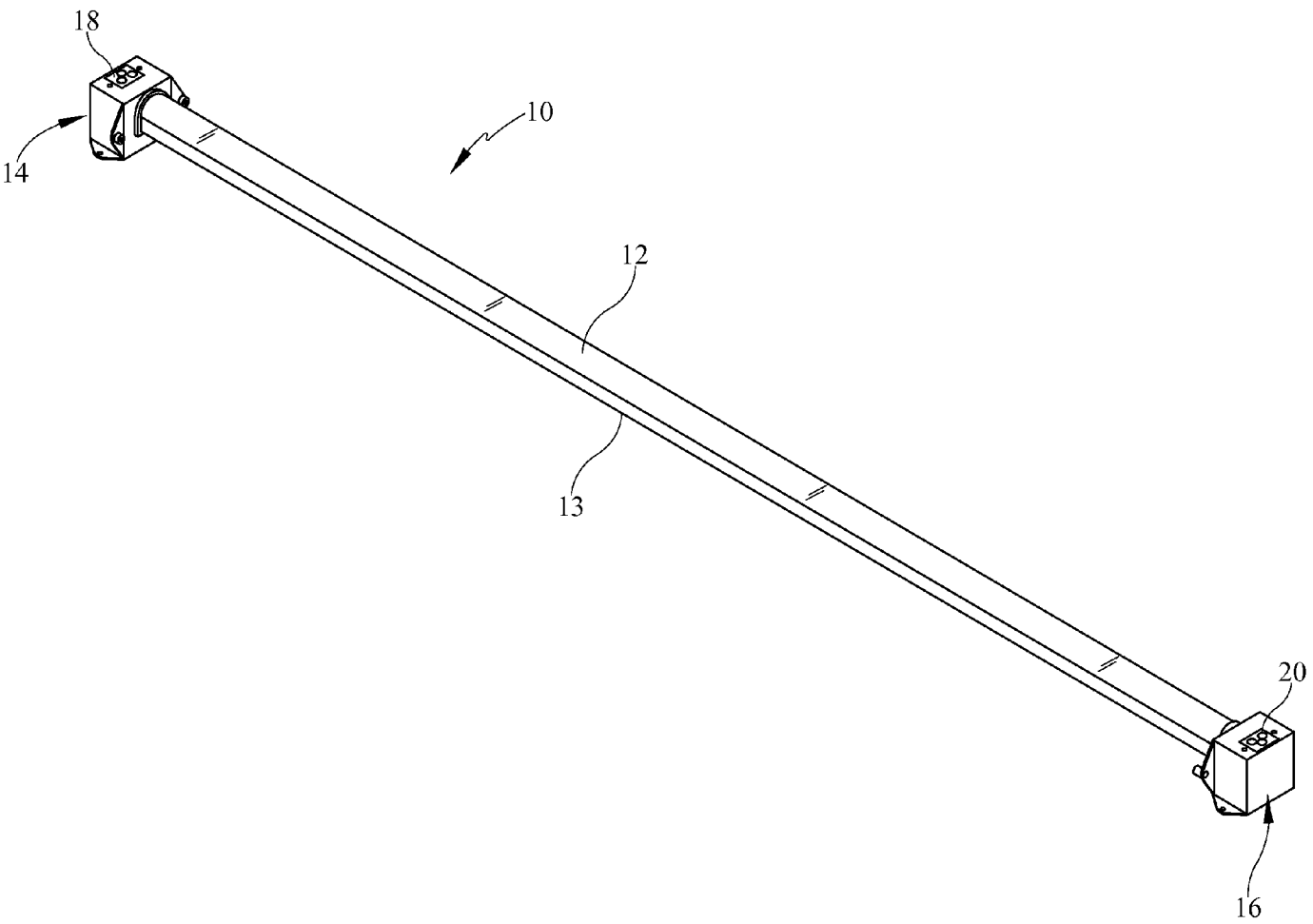
FIG. 1 is an upper perspective view of an LED luminaire of the present disclosure.
Figure 2:
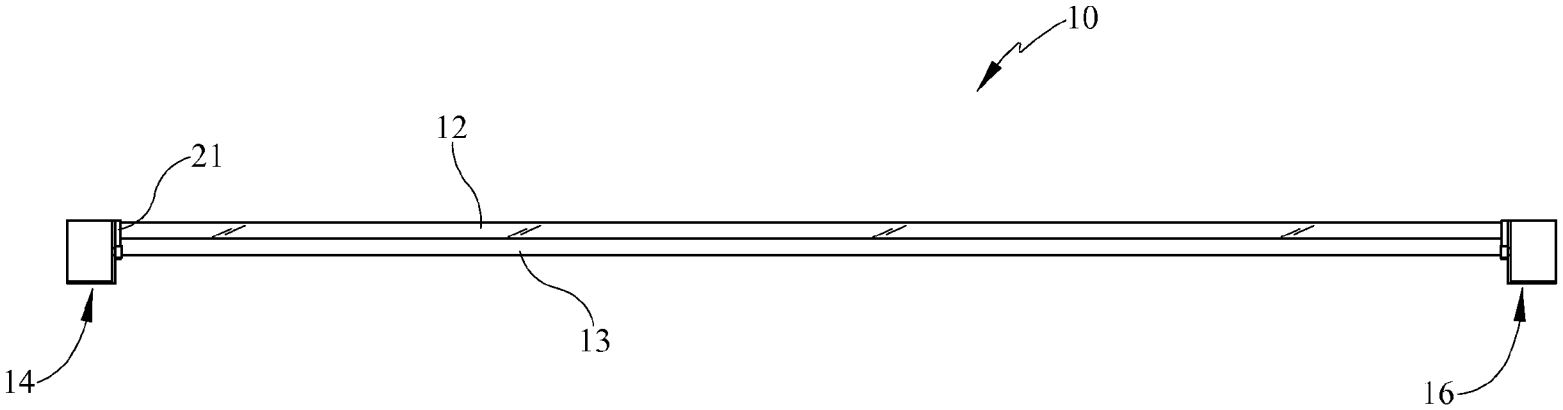
FIG. 2 is a side view of the LED luminaire shown in FIG. 1.
Figure 3:
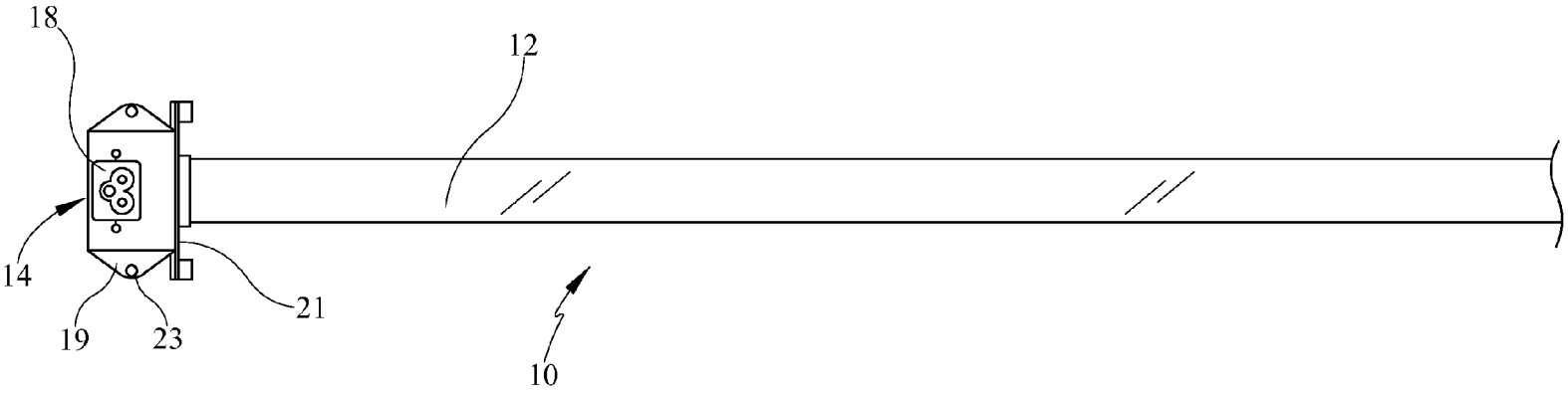
FIG. 3 is a top view of a portion of the LED luminaire shown in FIG. 1.
Figure 4:
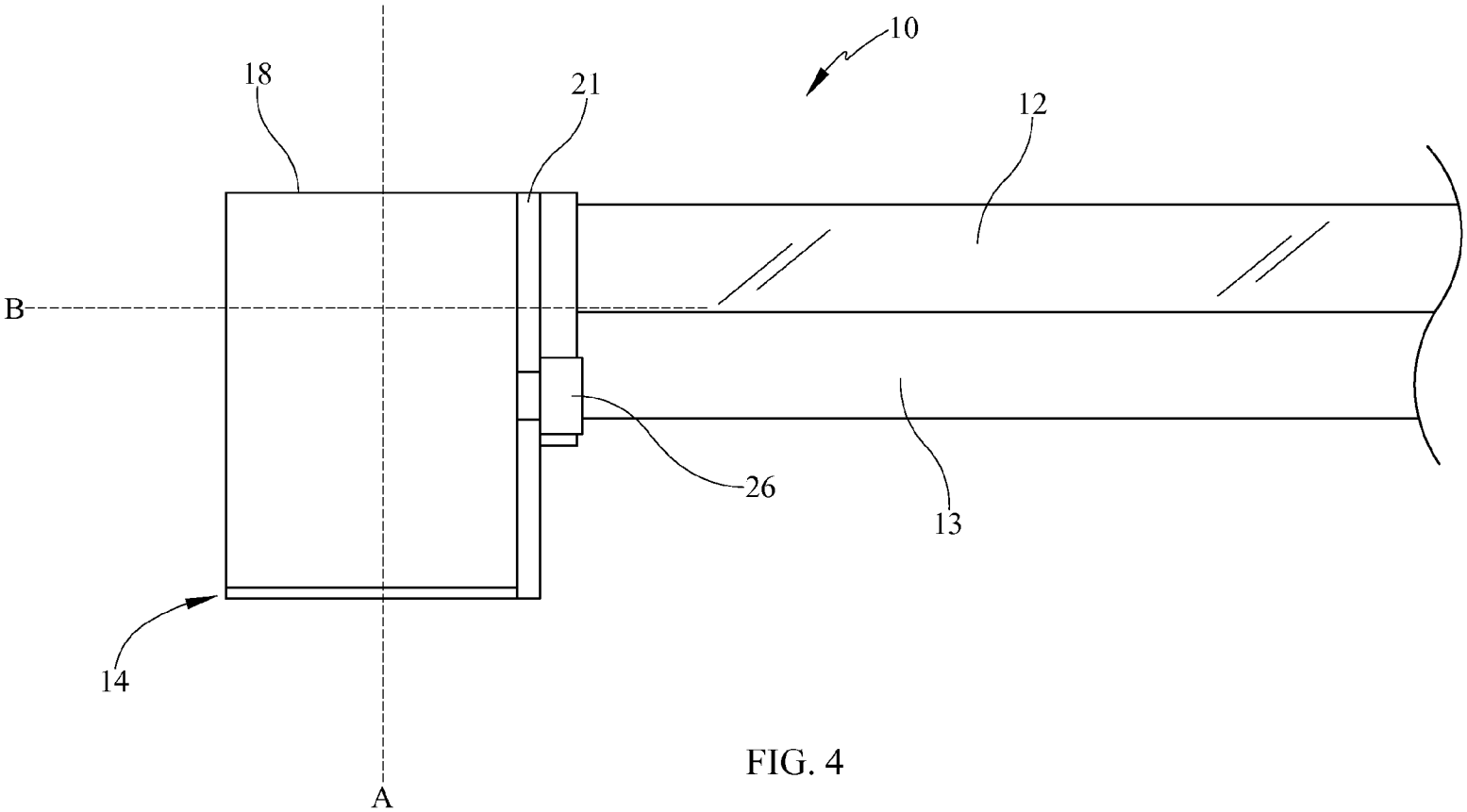
FIG. 4 is a side view of a portion of the LED luminaire shown in FIG. 1.

FIGS. 1 and 2 show an upper perspective view and a side view of luminaire 10. A top view of a portion of LED luminaire 10 and a side view of a portion of LED luminaire 10, are respectively shown in FIGS. 3 and 4. An LED lighting system of the present disclosure may comprise at least one LED luminaire 10. Luminaire 10 may comprise at least one longitudinally extending LED light source 12, having a length greater than a width. A first LED light source holder 14 may hold a first longitudinal end of each of the at least one longitudinally extending LED light sources 12. First LED light source holder 14 may have a first electrical socket 18 in electrical communication with a first end of each of the at least one longitudinally extending LED light sources 12, and a power source (not shown). It is to be understood that light source holder 14 may have other or additional electrical sockets disposed with first LED light source holder 14. A second LED light source holder 16 may hold a second longitudinal end of each of the at least one longitudinally extending LED light sources 12 held with first LED light source holder 14. Second LED light source holder 16 may have a second electrical socket 20 in electrical communication with a second end of each of the at least one longitudinally extending LED light sources 12. LED light source 12 may have a longitudinally extending portion 13, which may not emit light and may be a heat sink configured to dissipate heat generated by LEDs in LED light source 12.

First electrical socket 18 and second electrical socket 20 may each have a receiving axis "A" substantially perpendicular to a longitudinal axis "B" of the at least one longitudinally extending LED light source 12. Electrical sockets 18 and 20 may have substantially parallel receiving axes "A". For example, a first electrical socket 18 may be disposed on a bottom surface of first LED light source holder 14, as shown in FIG. 1, and second electrical socket 20 may be disposed on a top or bottom surface of first LED light source holder 16. In at least one embodiment, a first electrical socket 18 may be disposed on a side surface of first LED light source holder 14 and second electrical socket 20 may be disposed on the same or opposite side surface of first LED light source holder 16.

It is to be understood that first and second LED light source holders 14 and 16 may have additional and other electrical sockets disposed therewith, and have other and different orientations of their receiving axes, with respect to longitudinal axis "B". For example, in at least one embodiment of the present disclosure, first LED light source holder 14 has at least a first electrical socket 18 in electrical communication with a first end of each of the at least one longitudinally extending LED light sources 12, wherein first electrical socket 18 has a receiving axis substantially perpendicular to a longitudinal axis "B" of the at least one longitudinally extending LED light source 12. In at least one other embodiment of the present disclosure, second LED light source holder 16 has at least a first electrical socket 20 in electrical communication with a second end of each of the at least one longitudinally extending LED light sources 12, wherein second electrical socket 20 has a receiving axis substantially perpendicular to a longitudinal axis "B" of the at least one longitudinally extending LED light source 12. In at least one additional embodiment, first LED light source holder 14 has at least a first electrical socket 18 in a side, top, or bottom surface with its receiving axis substantially perpendicular to a longitudinal axis "B" of the at least one longitudinally extending LED light source 12. In at least one other embodiment, second LED light source holder 16 has at least a second electrical socket 20 in a side, top, or bottom surface with its receiving axis substantially perpendicular to a longitudinal axis "B" of the at least one longitudinally extending LED light source 12.

In at least one embodiment of the present disclosure, electrical sockets 18 and 20 may have substantially perpendicular receiving axes "A". For example, a first electrical socket 18 may be disposed on a top or bottom surface of first LED light source holder 14 and second electrical socket 20 may be disposed on a side surface of second LED light source holder 16. In at least one further embodiment of the present disclosure, luminaire 10 is void of an electrical socket on an end surface of LED light source holders 14 and 16. This configuration may enable a plurality of luminaires 10 to be adjacently aligned, end to end, in a row and provide for a lighting system having the plurality of luminaires with a common longitudinally extending axis "B" and in electrical communication with one another. In at least one additional embodiment of the present disclosure, electrical sockets 18 and 20 may have substantially the same configuration.

Figure 5:
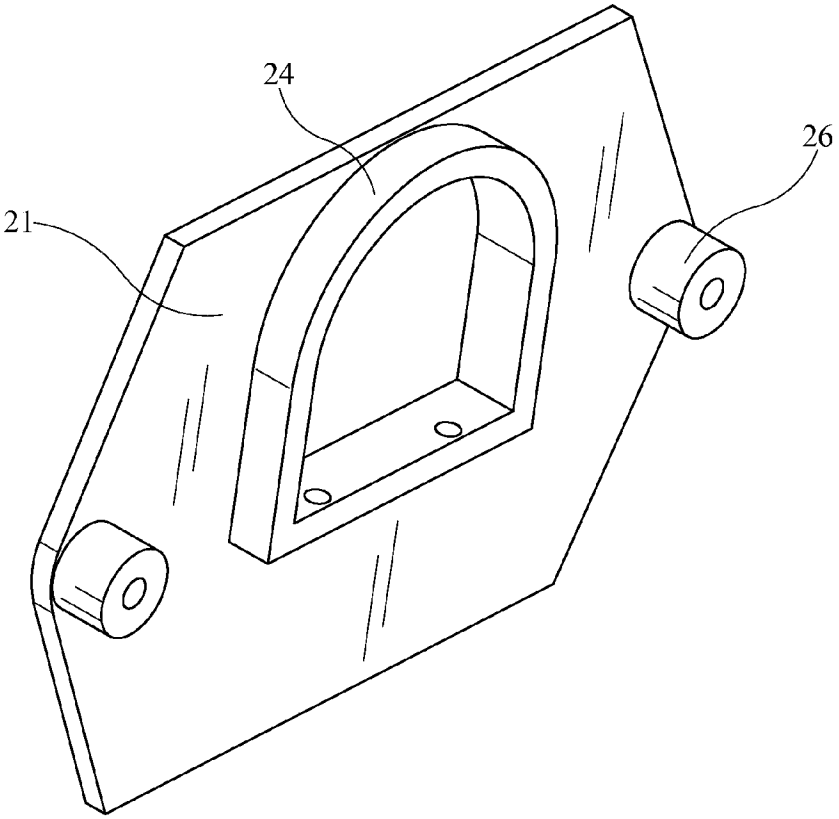
FIG. 5 is a perspective view of an LED light source support that may be used with the LED lighting system of the present disclosure.

FIG. 5 shows a perspective view of an LED light source support 21 that may be used with the LED lighting system of the present disclosure. LED light source support 21 may be configured to attached to an open side of LED light source holder 14 and/or 16 and have an outward extending portion 24 configured and disposed to cooperate with a longitudinal end of LED light source 12. For example, outwardly extending portion 24 may have an arced section and LED light source 10 may have a similarly arced section. LED light source support 21 may have one or more apertures 26 configured and disposed to receive a fastener and hold LED light source support 21 to LED light source holder 14 and/or 16. In at least one embodiment of the present disclosure, outward extending portion 21 is configured and disposed to enable LED light source holder 14 and/or 16 to hold a longitudinal end of LED light source 12. For example, outwardly extending portion 24 may be configured to extend about an outside end portion of LED light source 12.

Figure 6:
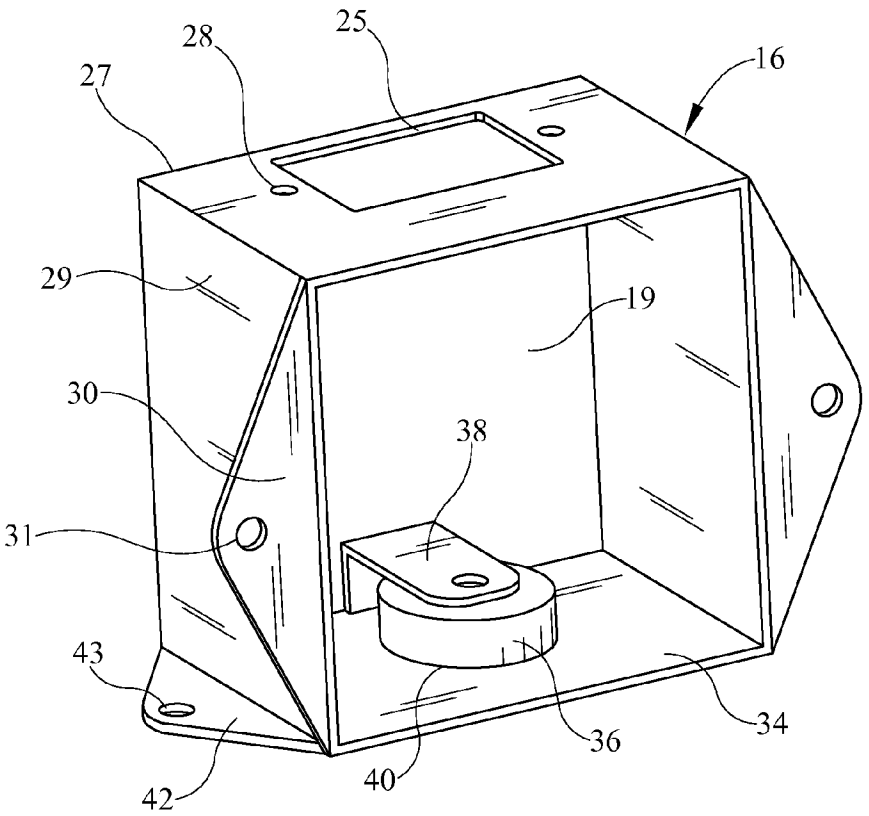
FIG. 6 is a perspective view of an LED light source holder of the present disclosure.

FIG. 6 shows a perspective view of LED light source holder 16. LED light source holder 16 may have a top wall 27 configured to hold an electrical socket, for example electrical socket 18. Top wall 27 may have an opening 25 configured to receive an electrical socket. Top wall 27 may have apertures 28 configured and disposed to receive a fastener for fastening the electrical socket in LED light source holder 16. LED light source holder 16 may have side walls 29 with outwardly extending flanges 30, having apertures 31, configured and disposed to attach an LED light source support thereto, for example LED light source support 21. End wall 19 may enclose an end of LED light source holder 16.

LED light source holder 16 may have a bottom wall 34. Bottom wall 34 may have outwardly extending flanges 42, having apertures 43, configured and disposed to hold a luminaire of the present disclosure to a structure, hang the luminaire from a structure, or hold the luminaire to a portion of a luminaire being retrofitted. LED light source holder 16 may have a magnet 36 disposed therewith. For example, leg 38 may extend over aperture 40 and may hold magnet 36 proximate aperture 40. In at least one embodiment of the present disclosure, magnet 36 is configured and disposed to hold LED light source holder 16 to a ferromagnetic material. In at least one other embodiment of a luminaire of the present disclosure comprising an LED light source holder with at least one magnet, the magnets may have a combined magnetic force for holding the luminaire, including at least one light source 12, to a ferromagnetic surface. For example, the luminaire of the present disclosure may be magnetically held to a troffer of a luminaire being retrofitted.

In at least one embodiment of LED light source holder 16, side wall 29 may have an opening 25 configured to receive an electrical socket. Side wall 29 may have apertures 28 configured and disposed to receive a fastener for fastening the electrical socket in LED light source holder 16.

Figure 7:
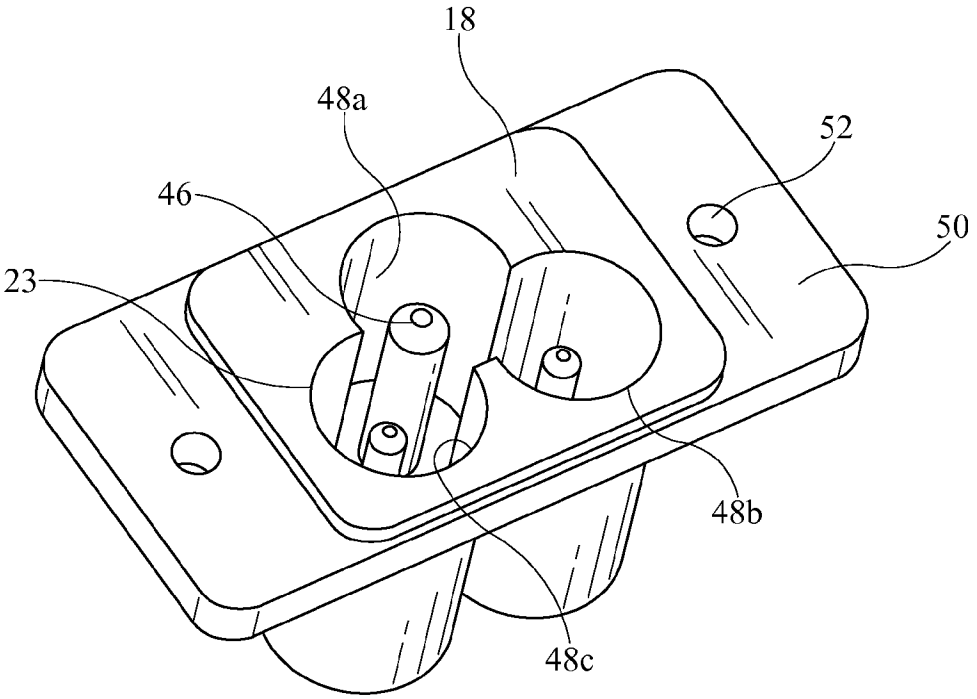
FIG. 7 is a perspective view of an electrical socket of the present disclosure.

FIG. 7 is a perspective view of electrical socket 18 of the present disclosure. Electrical socket 18 may comprise a first receptacle 48*a*, a second receptacle 48*b*, and a third receptacle 48*c*. First receptacle 48*a*, second receptacle 48*b*, and third receptacle 48*c* may each have a rounded female portion surrounding an electrically conductive pin 46. The rounded female portions of first receptacle 48*a*, second receptacle 48*b*, and third receptacle 48*c*, may overlap to form a tri-lobed electrical socket 18. Electrical socket 18 may have an outwardly extending flange 50, with apertures 52, configured and disposed for installing into a lamp holder. For example, electrical socket 18 may be placed in aperture 25, in LED light source holder 16, and fastened thereto, using apertures 28 and 52.

In at least one embodiment of the present disclosure, an LED lighting system comprises a first and a second electrical socket 18, each being disposed with a different lamp holder, wherein each electrical socket 18 has a substantially parallel receiving axes, for example receiving axis "A", and/or substantially the same configuration.

Figure 8:
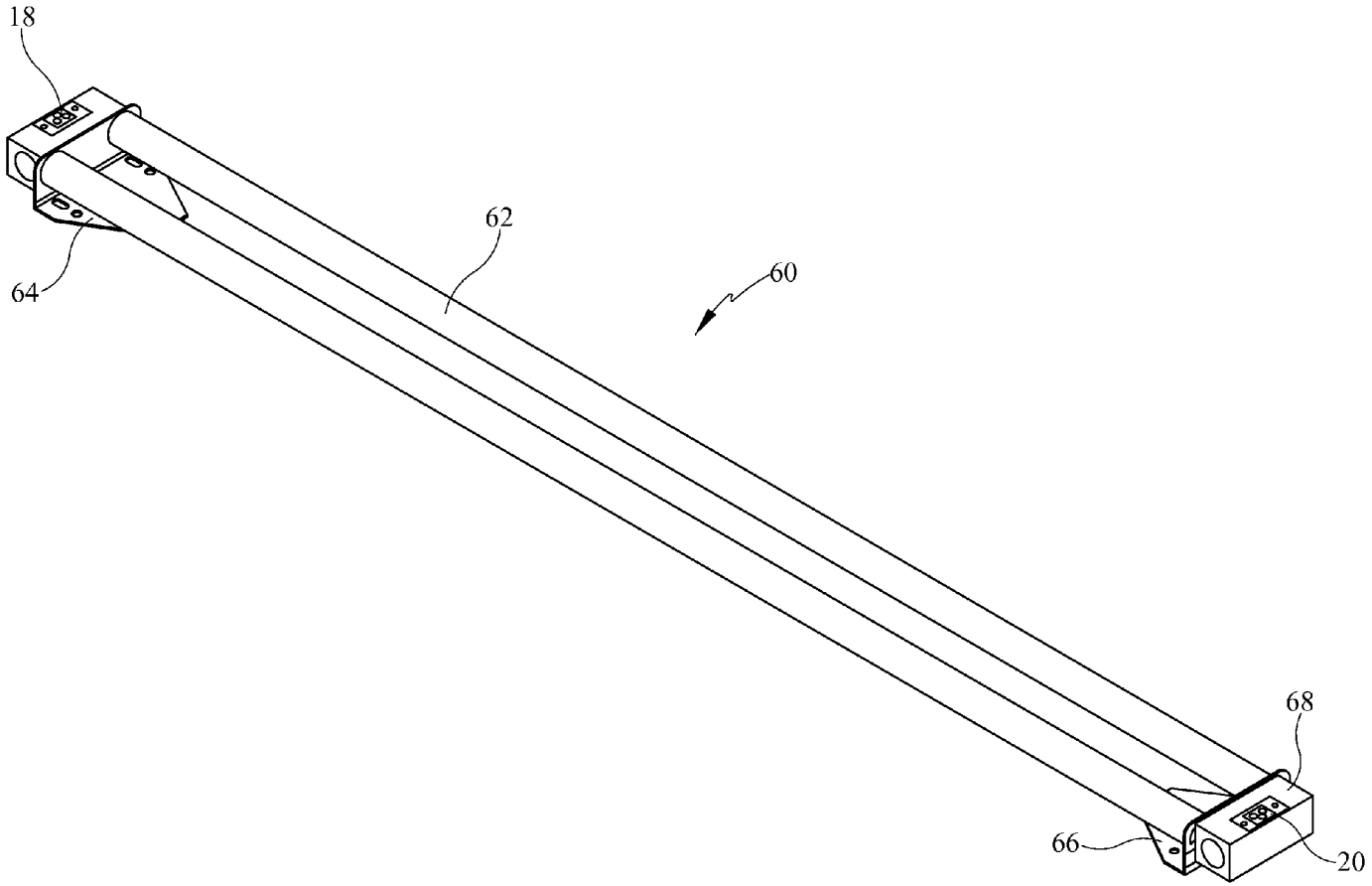
FIG. 8 is an upper perspective view of anther embodiment of an LED luminaire of the present disclosure.
Figure 9:
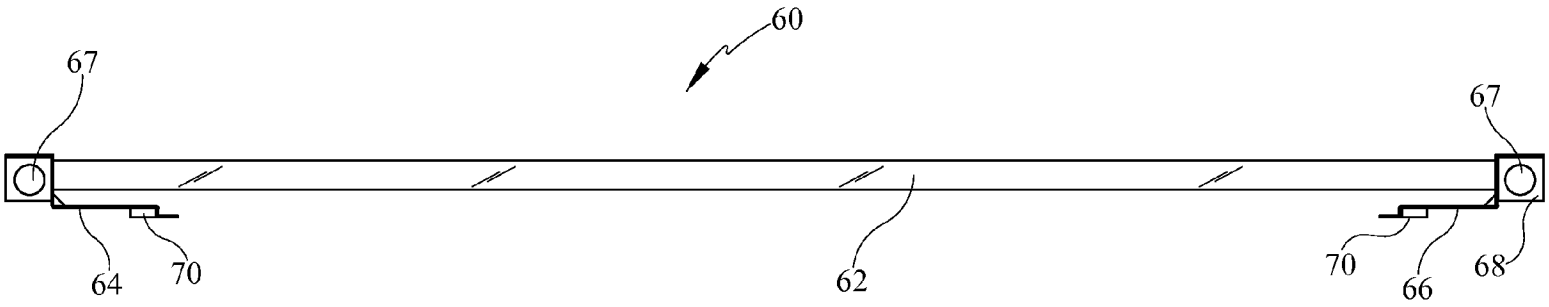
FIG. 9 is a side view of the LED luminaire shown in FIG. 8.
Figure 10:
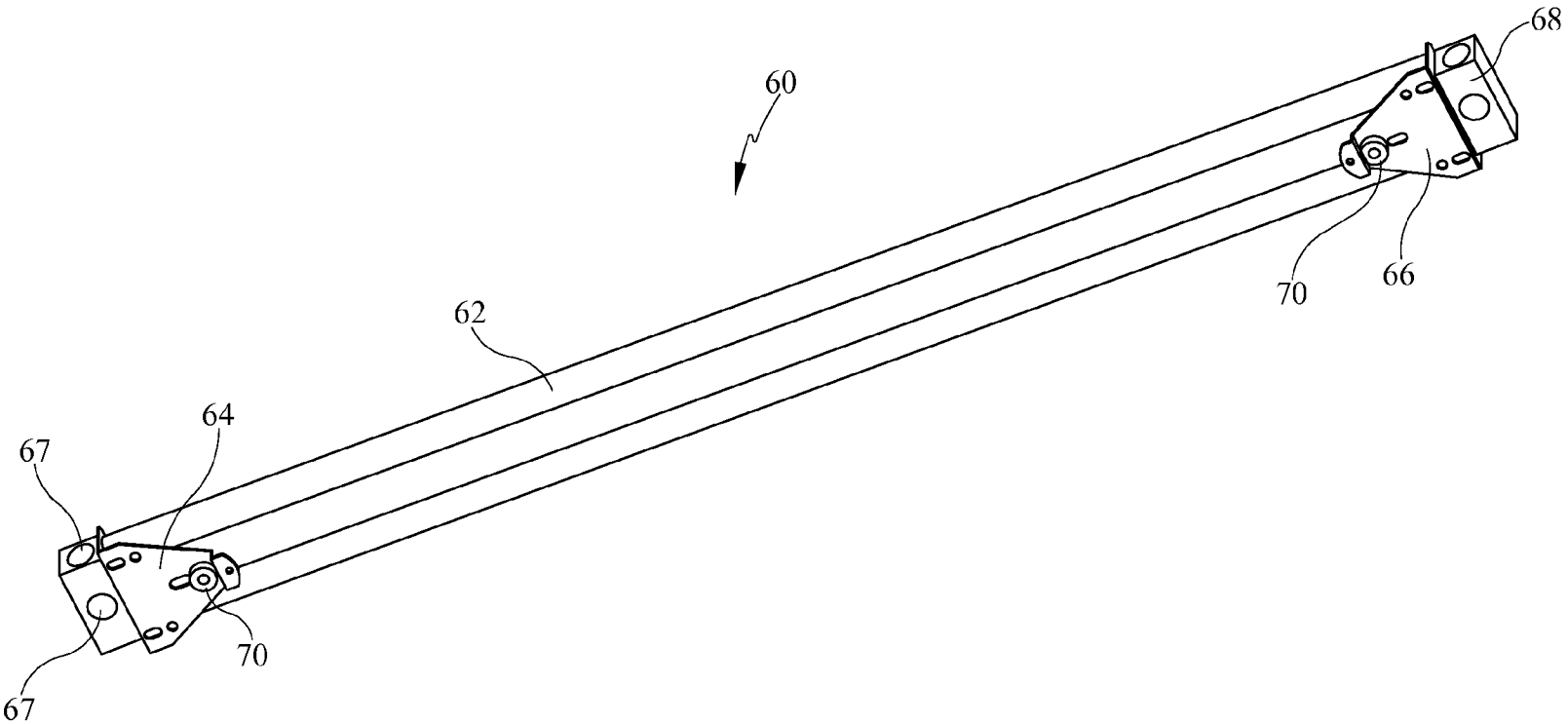
FIG. 10 is a lower perspective view of the LED luminaire shown in FIG. 8.

FIGS. 8-10 show an upper perspective view, a side view, and a lower perspective view of the LED luminaire 60, respectively. An LED retrofit system of the present disclosure may comprise at least one LED luminaire 60. LED luminaire 60 may comprise at least one longitudinally extending LED light source 62 having a length greater than a width. In at least one embodiment, light source 62 has a length greater than, or substantially greater than a width. A first LED light source holder 64 may hold a first longitudinal end of each of the at least one longitudinally extending LED light sources 62. First LED light source holder 64 may be configured to provide electrical communication between a first end of each of the at least one longitudinally extending LED light sources 62 and a power source, not shown.

Second LED light source holder 66 may hold a second longitudinal end of each of the at least one longitudinally extending LED light sources 62 held with first LED light source holder 64. First LED light source holder 64 and second LED light source holder 66 may be configured to hold luminaire 60 to a portion of a luminaire being retrofitted, such as a troffer, or a portion of a structure. For example, the LED retrofit system of the present disclosure may have first LED light source holder 64 and second LED light source holder 66 each comprising at least one magnet 70, wherein magnets 70 may be configured and disposed to hold first and second LED light source holders, 64 and 66, to a portion of an light fixture being retrofitted. In at least one embodiment, magnets 70 in LED light source holders 64 and 66 are configured to hold whole luminaire 60 to a ferromagnetic material.

The LED retrofit system of the present disclosure may have second LED light source holder 66 configured to provide electrical communication with a second end of each of the at least one longitudinally extending LED light sources 62. For example, the LED retrofit system of the present disclosure may have first LED light source holder 64 with a first electrical socket 18 and second LED light source holder 66 may have a second electrical socket 20. First and second electrical sockets, 18 and 20, may be in electrical communication with each other, for example electrical communication may be through one or more LED light sources 62. First and second electrical sockets 18 and 20 may have their receiving axis substantially perpendicular to a longitudinal axis of the at least one longitudinally extending LED light source 62. In at least one embodiment of the present disclosure, one or both LED light source holders, 64 and/or 66, may have electrical sockets 18 and 20 in top walls as shown in FIGS. 8-10, or in their side walls. For example, LED light source holders, 64 and/or 66, may have electrical sockets 18 and 20 in place of the knockouts 67 in the side walls disposed perpendicular with the top wall, such as in place of knockouts 67 shown in FIG. 9.

Figure 11:
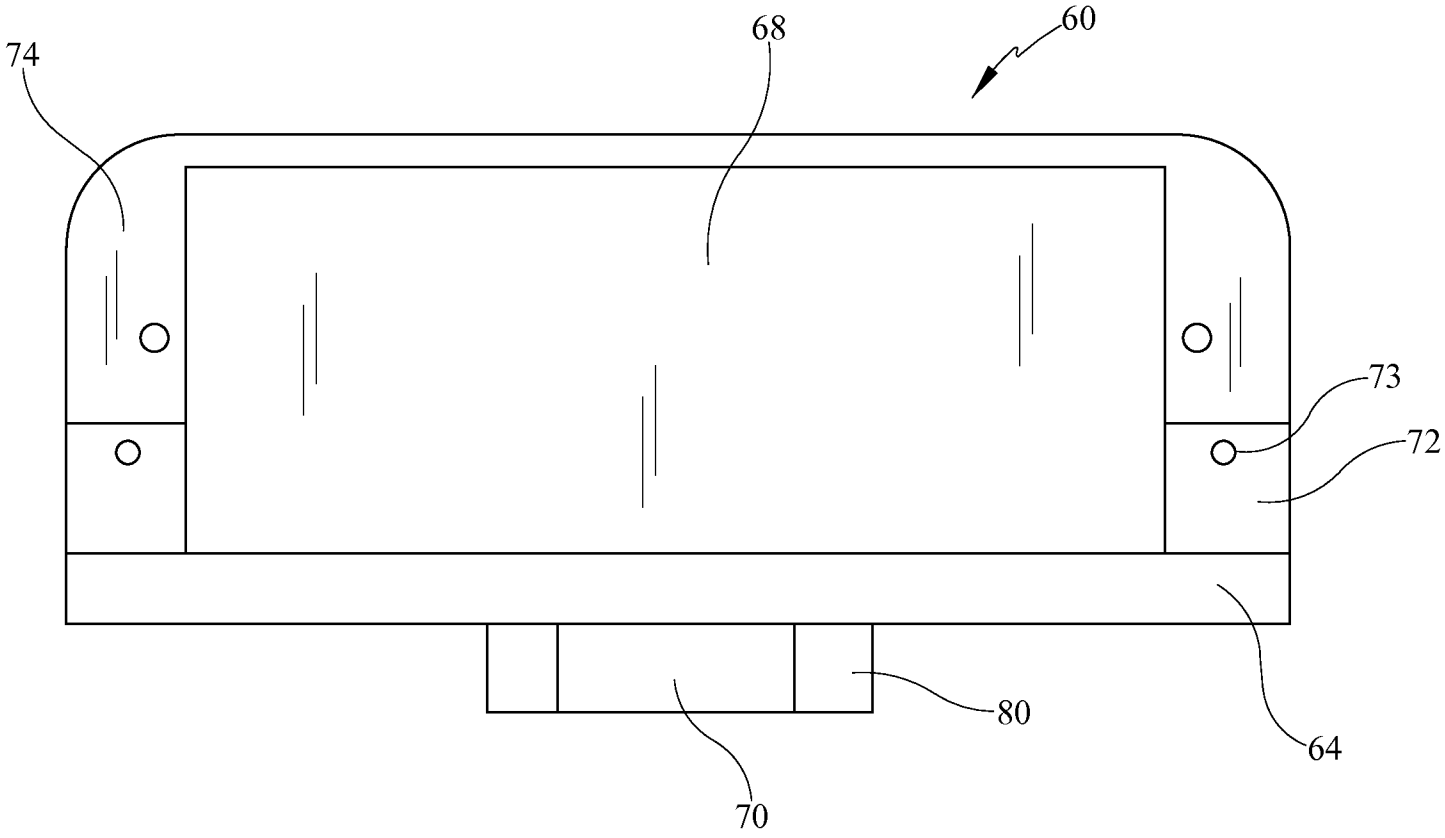
FIG. 11 is an end view of the LED luminaire shown in FIG. 8.

FIG. 11 shows an end view of LED luminaire 60. LED luminaire 60 may comprise LED light source holder 64. LED light source holder 64 may comprise a holding plate 74 having electrical cover 68 attached thereto. Electrical cover 68 may be configured and disposed to cover electrical connections between each LED light source 62 to be held therewith and optionally a power source, not shown. Electrical cover 68 may have outwardly extending tabs 72, having apertures 73, configured and disposed to align with apertures in holding plate 74 and receive a fastener for fastening electrical cover 68 to LED light source holder 64. Magnet 70 may be held with LED light source holder 64. Magnet 70 may be configured and disposed to hold at least LED light source holder 64 to a ferromagnetic material.

Figure 12:
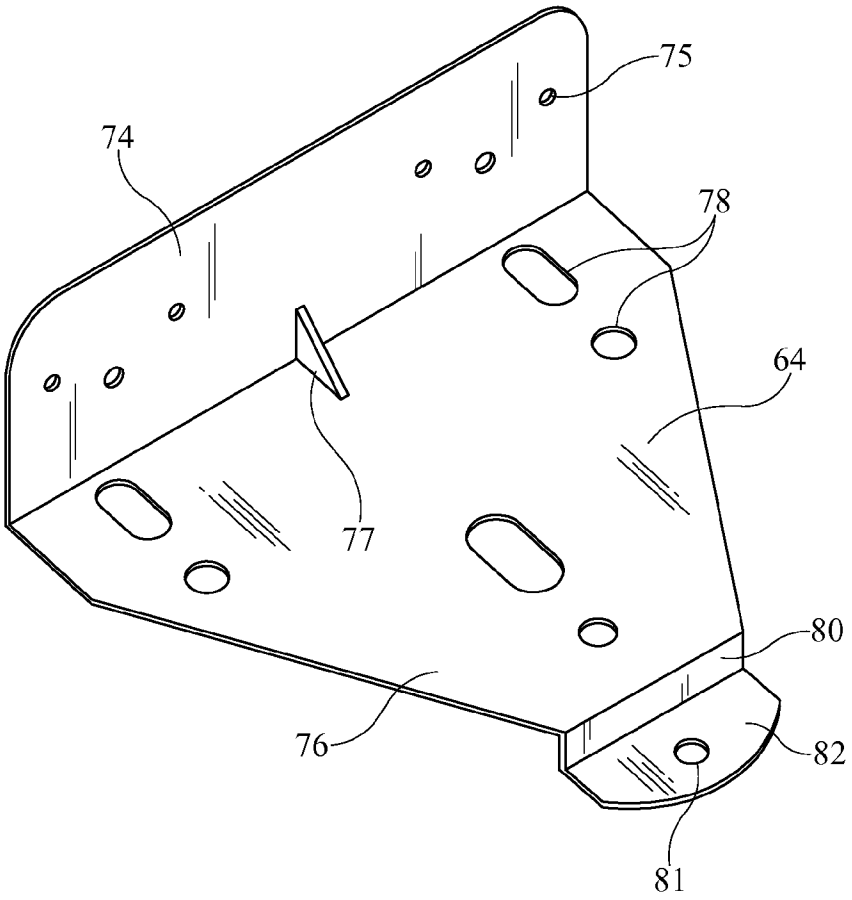
FIG. 12 is a perspective view of an LED light source holder that may be incorporated with the LED luminaire shown in FIG. 8.

FIG. 12 shows a perspective view of LED light source holder 64. Lamp holder 64 may have vertically oriented holding plate 74 with apertures 75. Apertures 75 may be configured and disposed to provide electrical communication to at least one LED light source 62. For example, apertures 75 may be arranged in sets wherein each set is configured and disposed to provide electrical communication to a sole LED light source 62 and/or attach the LED light source 62 to holding plate 74. Holding plate 74 may have additional apertures, for example, holding plate 74 may have apertures for aligning with apertures 73 and attaching electrical cover 68 thereto.

LED light source holder 64 may have a first horizontal inwardly extending portion 76. One or more ribs 77 may extend between holding plate 74 and first horizontal inwardly extending portion 76, which may provide structural support therebetween. First horizontal inwardly extending portion 76 may have apertures and/or slots 78 configured and disposed to attach LED light source holder 64 to a portion of a structure or a portion of a luminaire being retrofitted. First horizontal inwardly extending portion 76 may have a triangular portion extending to a vertically extending portion 80. First horizontal inwardly extending portion 76 may be configured to hold a magnet 70 proximate, or adjacent, vertically extending portion 80. Vertically extending portion 80 may extend a distance to provide a second horizontal inwardly extending portion 82, having aperture 81, with a surface substantially within a plane of a surface of magnet 70 held with first horizontal inwardly extending portion 76. Apertures 81 may be disposed for fastening LED light source holder 64 to a portion of a structure or luminaire being retrofitted.

Figure 13:
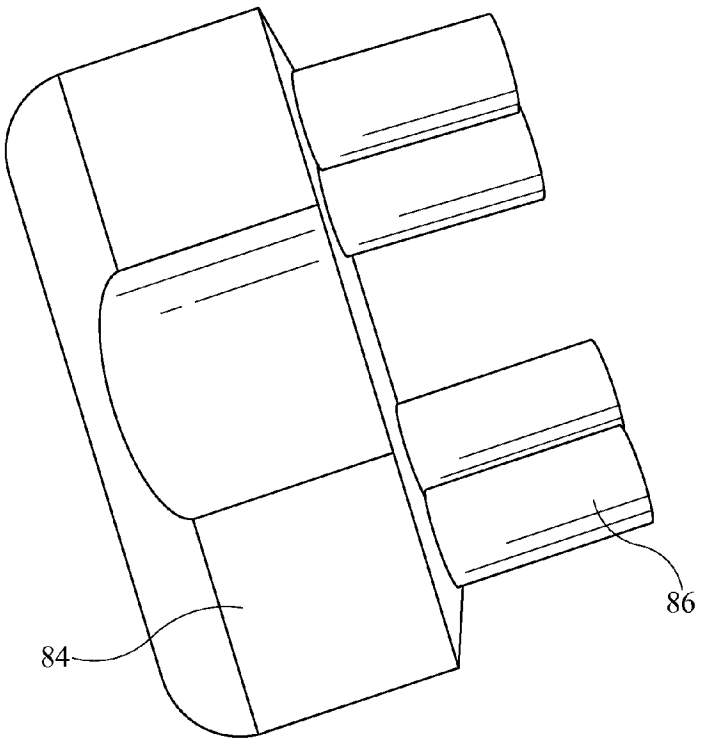
FIGS. 13-14 are perspective views of an electrical plug that may be used in the LED lighting system of the present disclosure.
Figure 14:
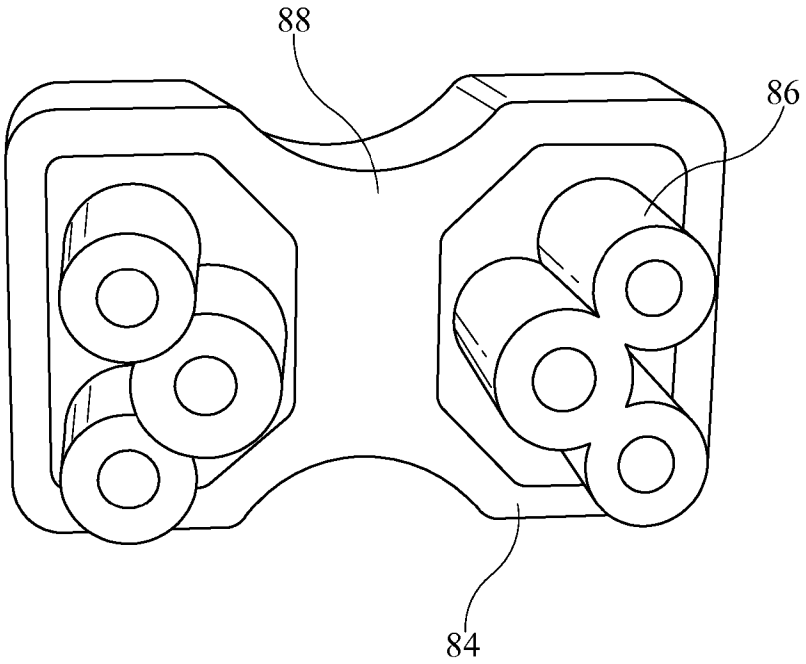

FIGS. 13-14 show electrical plug 84 that may be incorporated with the LED lighting system of the present disclosure. A lighting system of the present disclosure may comprise an electrical plug 84 configured to electrically connect a first luminaire with a second luminaire. For example, a first luminaire may have a first LED light source holder with a first electrical socket in electrical communication with a first end of each of at least one longitudinally extending LED light sources and a power source. The first luminaire may have a second LED light source holder holding a second longitudinal end of each of the at least one longitudinally extending LED light sources held with the first LED light source holder. The second LED light source holder may have a second electrical socket in electrical communication with a second end of each of the at least one longitudinally extending LED light sources held with the first LED light source holder. In this aspect of the LED lighting system of the present disclosure, electrical plug 84 may be plugged into two luminaires and may provide electrical communication between the two luminaires.

For example, a second luminaire may have a first LED light source holder with a first electrical socket in electrical communication with a first end of each of at least one longitudinally extending LED light sources. The second electrical socket of the first luminaire may be placed in electrical communication with the first electrical socket of the second luminaire with plug 84. In this respect, a plurality of luminaires may be daisy chained to provide a lighting system of the present disclosure having a plurality of luminaires. For example, two or more luminaires of the present disclosure may be placed end to end, side to side, or proximate one another, and electrically connected with an adjacent, or proximate, luminaire with electrical plug 84.

Electrical plug 84 may comprise a tri-lobed male electrical connector 86 extending from each end thereof. Each tri-lobed electrical connector 84 may extend substantially parallel with one another and may be configured to become substantially perpendicular with the longitudinal axis of at least one longitudinally extending LED light source, held with the lighting system of the present disclosure, upon plugging into electrical sockets of adjacent, or proximate, luminaires.

Electrical plug 84 may have a first and second electrical connector 86 and an electrical extension 88 extending between the first and second electrical connectors 86. Electrical plug 84 may be configured to laterally hold two luminaires with each other. Electrical extension 88 may be configured to hold two luminaires to have their LED light source holders, or electrical covers, adjacent one another. In at least one embodiment, electrical extension 88 may be rigid. In at least one other embodiment, electrical extension 88 may comprise a length of wire to provide spacing between two luminaires in electrical communication with one another.

In at least one embodiment, electrical plug 88 is configured to electrical connect with electrical sockets 18. For example, an electrical connector 86 may be tri-lobed and configured to be received with first receptacle 48*a*, second receptacle 48*b*, and third receptacle 48*c*, of electrical socket 18, and provide electrical communication between electrically conductive pins 46 in electrical sockets 18 of two luminaires in the lighting system of the present disclosure.

Figure 15:
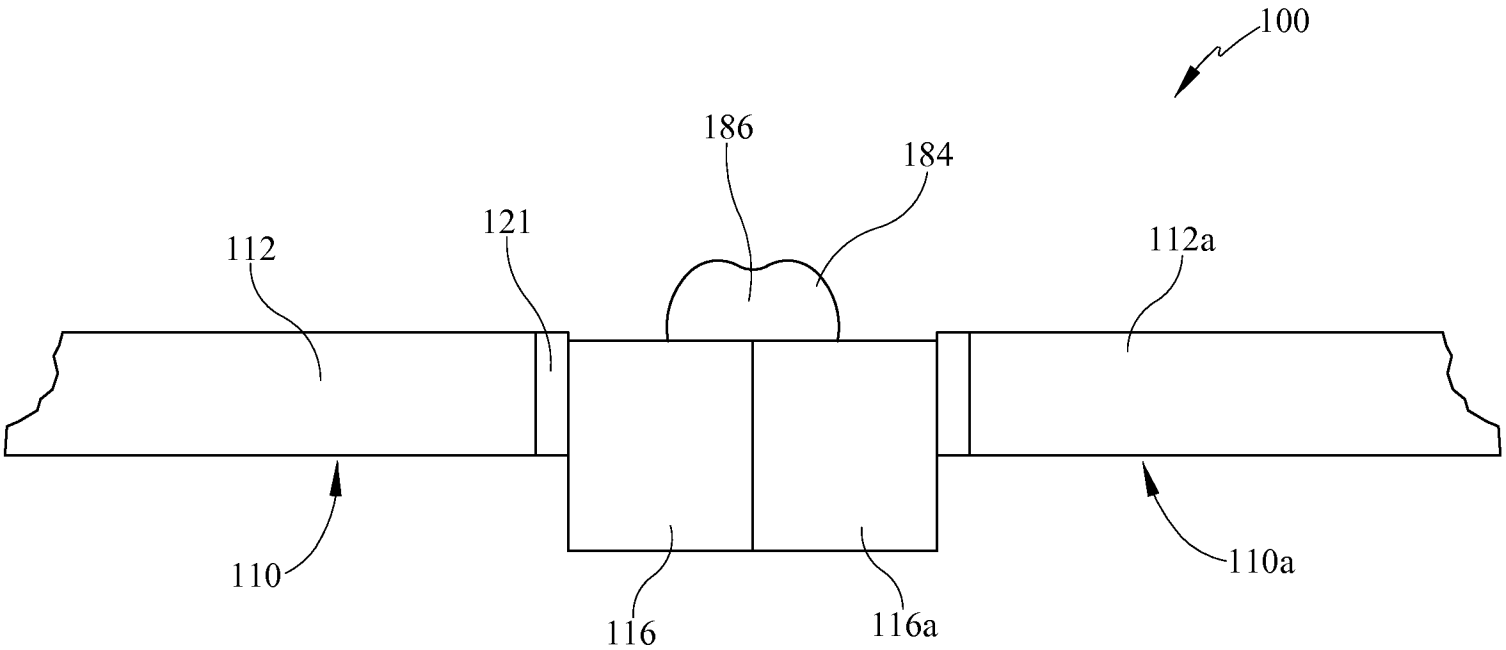
FIG. 15 shows an LED lighting system of the present disclosure having two luminaires electrically connected with the electrical plug shown in FIG. 14.

FIG. 15 shows LED lighting system 100 of the present disclosure having two luminaires 110 and 110*a* electrically connected with the electrical plug 184. LED lighting system 100 may comprise at least a first LED luminaire 110, a second LED luminaire 110*a*, and an electrical plug 184. Each luminaire 110 and 110*a* may comprise at least one LED light source 112 or 112*a* and LED light source holders 116 or 116*a*, holding longitudinal ends of LED light sources 112 or 112*a*. Luminaire 110 and/or 110*a* may comprise an LED light source support 121. Electrical plug 184 is shown electrically connecting a second electrical socket, in LED light source holder 116, of the first LED luminaire 110, with the first electrical socket, in LED light source holder 116*a*, of the second LED luminaire 110*a*.

Electrical plug 184 may comprise electrical connectors extending substantially parallel with one another, into LED light source holders 116 and 116*a*, and substantially perpendicular with the longitudinal axis of at least one longitudinally extending LED light sources 112 and 112*a*. For example, electrical plug 184 may extend into the top walls of LED light source holders 116 and 116*a*, as shown in FIG. 15, or in the side walls in an embodiment having electrical sockets disposed with the side walls.

Electrical plug 184 may have first and second electrical connectors, extending into LED light source holders 116 and 116*a*, and an electrical extension 188 extending between the first and second electrical connectors. Electrical plug 184 may laterally hold LED luminaire 110 with LED luminaire 110*a*, maintaining a distance or abutment between LED luminaires 110 and 110*a*. Electrical plug 184 may have electrical extension 188 with a length and rigidity to laterally hold luminaires 110 and 110*a* together to have their LED light source holders 116 and 116*a* adjacent one another. It is to be understood that electrical extension 188 may flexible or non-rigid, for example a length of wire, to provide desired spacing between luminaires 110 and 110*a*.

Luminaire 110 may have a second LED light source holder 116 with a second electrical socket in electrical communication with a second end of each of at least one longitudinally extending LED light sources 112. Second LED light source holder 116 of first luminaire 110 may be placed in electrical communication with the first LED light source holder 116*a*, of the second luminaire 110*a*, with plug 184. In this respect, a plurality of luminaires, 110, 110*a*, . . . , may be daisy chained to provide a lighting system of the present disclosure having a plurality of luminaires. For example, two or more luminaires of the present disclosure may be placed end to end, as shown in FIG. 15, side to side, or proximate one another, and electrically connected with an adjacent, or proximate, luminaire, with electrical plug 184.

The luminaires of the present disclosure may hold one, two, three, or more LED light sources. For example, luminaire 10 is shown holding one LED light source 12 and luminaire 60 is shown holding two LED light sources 62. It is to be understood that the LED lighting system of the present disclosure may have at least one luminaire having 4, 5, or more LED light sources, in increments of 1. For example, the lighting system of the present disclosure may comprise at least one luminaire holding 6, 10, 12, 24, or more LED light sources.

The lighting system of the present disclosure may comprise at least one luminaire having a variety of configurations of electrical sockets and electrical plugs. For example, an electrical socket of the present disclosure may have two, three, four, or more, electrical receptacles and the receptacles may be in a variety of configurations. It is also within the present disclosure to provide two, three, four, or more, prongs on an electrical plug and the prongs may be in a variety of configurations for plugging into the electrical sockets.

As will be understood by one skilled in the art, for any and all purposes, such as in terms of providing a written description, all ranges disclosed herein also encompass any and all possible sub-ranges and combinations of sub-ranges thereof. As will also be understood by one skilled in the art all language such as "up to," "at least," "greater than," "less than," and the like include the number recited and refer to ranges which can be subsequently broken down into sub-ranges as discussed above.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An LED lighting system comprising at least one LED luminaire, each of the at least one LED luminaire comprising:

at least one longitudinally extending LED lamp having a length substantially greater than a width;

a first LED lamp holder having an enclosed outer perimeter parallel with the at least one longitudinally extending LED lamp, an end wall extending from edges of the enclosed outer perimeter and enclosing an outer end of the first lamp holder, and a light source support extending from edges of the enclosed outer perimeter and parallel with the end wall and holding a first longitudinal end of each of the at least one longitudinally extending LED lamps;

a first electrical socket extending into the enclosed outer perimeter of the first LED lamp holder, the first electrical socket being in electrical communication with a first end of each of the at least one longitudinally extending LED lamps and a power source;

a second LED lamp holder having an enclosed outer perimeter parallel with the at least one longitudinally extending LED lamp, an end wall extending from edges of the enclosed outer perimeter and enclosing an outer end of the second lamp holder, and a light source support extending from edges of the enclosed outer perimeter and parallel with the end wall and holding a second longitudinal end of each of the at least one longitudinally extending LED lamps held with the first LED lamp holder;

a second electrical socket extending into the enclosed outer perimeter of the second LED lamp holder, the second electrical socket being in electrical communication with a second end of each of the at least one longitudinally extending LED lamps; and the first electrical socket and the second electrical socket each having an outer surface substantially in a plane of the enclosed outer perimeter into which it is extending and being configured to receive a plug and having a plug receiving axis substantially perpendicular to a longitudinal axis of the at least one longitudinally extending LED lamp.

2. The LED lighting system of claim 1, wherein the enclosed outer perimeter of the first LED lamp holder has a top wall, a bottom wall parallel with the top wall, and a side wall extending between each of the parallel edges of the top wall and the bottom wall, the enclosed outer perimeter of the second LED lamp holder has a top wall, a bottom wall parallel with the top wall, and a side wall extending between each of the parallel edges of the top wall and the bottom wall, and the first and second electrical sockets have substantially parallel receiving axes.

3. The LED lighting system of claim 1 wherein at least one of the first and second electrical sockets comprises a first receptacle, a second receptacle, and a third receptacle.

4. The LED lighting system of claim 3 wherein the first, the second, and the third receptacles are configured to receive a tri-pin or tri-prong plug.

5. The LED lighting system of claim 1 comprising at least a first LED luminaire, a second LED luminaire, and an electrical plug, wherein the electrical plug electrically connects the second electrical socket of the first LED luminaire with the first electrical socket of the second LED luminaire.

6. The LED lighting system of claim 5, wherein the electrical plug holds the second LED lamp holder of the first LED luminaire substantially adjacent the first LED lamp holder of the second LED luminaire.

7. The LED lighting system of claim 6, wherein the first and the second LED luminaires have the longitudinal axes of their at least one longitudinally extending LED lamp substantially aligned.

8. The lighting system of claim 7, wherein the electrical plug comprises at least one male electrical connector extending from an end thereof, the male connector extending substantially parallel with another connector extending from the other end of the plug, each plug connector having a connecting axis substantially perpendicular with the longitudinal axis of the at least one longitudinally extending LED lamp.

9. The LED lighting system of claim 5, wherein the electrical plug has a first electrical connector, a second electrical connector, and an electrical extension extending between the first and second electrical connectors.

10. The lighting system of claim 1, wherein each of the at least one LED luminaire is configured to be retrofitted with a fluorescent LED lamp housing.

11. An LED lighting system comprising at least one LED luminaire, each of the at least one LED luminaire comprising:

at least one longitudinally extending LED lamp having a length substantially greater than a width;

a first LED lamp holder holding a first longitudinal end of each of the at least one longitudinally extending LED lamps;

the first LED lamp holder having an enclosed outer perimeter parallel with the at least one longitudinally extending LED lamp and a first electrical socket extending into the enclosed outer perimeter with a receiving axis substantially perpendicular to a longitudinal axis of the at least one longitudinally extending LED lamp, the first electrical socket being configured to receive a plug and provide electrical communication between a first end of each of the at least one longitudinally extending LED lamps and a power source;

a second LED lamp holder holding a second longitudinal end of each of the at least one longitudinally extending LED lamps held with the first LED lamp holder; and the first LED lamp holder and the second LED lamp holder are configured to hold the luminaire to a structure, hang the luminaire from a structure, or hold the luminaire to a portion of a luminaire being retrofitted.

12. The LED lighting system of claim 11, wherein the second LED lamp holder is configured to provide electrical communication with a second end of each of the at least one longitudinally extending LED lamps.

13. The LED lighting system of claim 12, wherein the second LED lamp holder has a second electrical socket with its receiving axis substantially perpendicular to the longitudinal axis of the at least one longitudinally extending LED lamp.

14. The LED lighting system of claim 13 comprising at least a first LED luminaire, a second LED luminaire, and an electrical plug, wherein the electrical plug electrically connects the second electrical socket of the first LED luminaire with the first electrical socket of the second LED luminaire.

15. An LED retrofit system comprising at least one LED luminaire, each of the at least one LED luminaire comprising:

at least one longitudinally extending LED lamp having a length substantially greater than a width;

a first LED lamp holder holding a first longitudinal end of each of the at least one longitudinally extending LED lamps;

the first LED lamp holder having an enclosed outer perimeter parallel with the at least one longitudinally extending LED lamp and a first electrical socket extending into the enclosed outer perimeter, the first electrical socket having a plug receiving axis substantially perpendicular to a longitudinal axis of the at least one longitudinally extending LED lamp configured to receive a plug and provide electrical communication between a first end of each of the at least one longitudinally extending LED lamps and a power source;

a second LED lamp holder holding a second longitudinal end of each of the at least one longitudinally extending LED lamps held with the first LED lamp holder; and the first LED lamp holder and the second LED lamp holder are configured to hold the luminaire to a portion of a luminaire being retrofitted.

16. The LED retrofit system of claim 15 wherein first LED lamp holder and the second LED lamp holder each comprise at least one magnet, wherein the magnets are configured and disposed to hold the retrofit system to a portion of a LED lamp fixture being retrofitted.

17. The LED retrofit system of claim 15, wherein the second LED lamp holder is configured to provide electrical communication with a second end of each of the at least one longitudinally extending LED lamps.

18. The LED retrofit system of claim 17, wherein the second LED lamp holder has a second electrical socket, the second electrical socket having a receiving axis substantially perpendicular to a longitudinal axis of the at least one longitudinally extending LED lamp.

19. The LED lighting system of claim 18 comprising at least a first LED luminaire, a second LED luminaire, and an electrical plug, wherein the electrical plug electrically connects the second electrical socket of the first LED luminaire with the first electrical socket of the second LED luminaire.

* * * * *